US009028273B2

(12) United States Patent
Smith et al.

(10) Patent No.: US 9,028,273 B2
(45) Date of Patent: May 12, 2015

(54) ELECTRICAL CONNECTOR ASSEMBLY WITH ENVIRONMENTAL SHIELD

(71) Applicant: Curtiss-Wright Flow Control Service Corporation, Falls Church, VA (US)

(72) Inventors: Alan Stephen Smith, Madison, AL (US); Gary Joseph Elam, Huntsville, AL (US)

(73) Assignee: Curtiss-Wright Flow Control Service Corporation, Falls Church, VA (US)

( * ) Notice: Subject to any disclaimer, the term of this patent is extended or adjusted under 35 U.S.C. 154(b) by 144 days.

(21) Appl. No.: 13/924,856

(22) Filed: Jun. 24, 2013

(65) Prior Publication Data

US 2014/0377985 A1 Dec. 25, 2014

(51) Int. Cl.
*H01R 13/52* (2006.01)

(52) U.S. Cl.
CPC ..... *H01R 13/5205* (2013.01)

(58) Field of Classification Search
CPC .. H01R 13/52; H01R 13/5216; H01R 13/521; H01R 13/5219; H01R 13/5205; H01R 43/005; H01R 13/5202; H01R 4/22
USPC ..... 439/519, 271, 274, 587–589
See application file for complete search history.

(56) References Cited

U.S. PATENT DOCUMENTS

| | | | | |
|---|---|---|---|---|
| 5,104,340 | A | 4/1992 | Elam et al. | |
| 7,303,418 | B2 * | 12/2007 | O'Connor | 439/277 |
| 7,988,476 | B2 * | 8/2011 | Billman et al. | 439/271 |
| 8,574,007 | B2 * | 11/2013 | Smith et al. | 439/607.5 |
| 8,814,608 | B2 * | 8/2014 | Song et al. | 439/814 |

* cited by examiner

*Primary Examiner* — Xuong Chung Trans
(74) *Attorney, Agent, or Firm* — Pearne & Gordon LLP

(57) ABSTRACT

An electrical connector assembly for providing an environmental shield includes a bushing adapter configured to sealingly engage a bushing assembly accommodating a first electrical conductor. The bushing adapter further includes a first bore extending longitudinally therethrough to receive the first electrical conductor. An end fitting includes a second bore extending longitudinally therethrough to receive a second electrical conductor, and the end fitting is configured to sealingly engage the bushing adapter such that the first and second bores cooperate to define a main bore. A flowable dielectric material occupies substantially all empty space within the main bore, and at least one fill hole is in fluid communication with the main bore and configured to receive the flowable dielectric material. A method of assembling the electrical connector assembly is also provided.

20 Claims, 6 Drawing Sheets

ELECTRICAL CONNECTOR ASSEMBLY WITH ENVIRONMENTAL SHIELD

CROSS-REFERENCE TO RELATED APPLICATIONS

Not applicable.

FIELD OF THE INVENTION

The present invention relates generally to electrical connectors and, more particularly, to an electrical connector assembly with an environmental shield.

BACKGROUND OF THE INVENTION

Electrical connectors are common in the nuclear industry. However, various environmental conditions may be present that can cause disturbances in the electrical connectors. For example, harsh and/or corrosive environments, such as those often encountered in a nuclear generating station, can subject electrical connectors to high doses of radiation and vibration, considerable heat and moisture often in the form of superheated steam, and numerous other corrosive chemicals. Where an electrical connector is used to splice together two or more electrical conductors, the connection can be susceptible to the effects of the environmental conditions after periods of exposure due to openings or other penetrations in the electrical connector. The disturbances can interrupt, obstruct, and/or degrade the electrical signal transferred between the electrical conductors.

BRIEF SUMMARY OF THE INVENTION

The following presents a simplified summary of the invention in order to provide a basic understanding of some example aspects of the invention. This summary is not an extensive overview of the invention. Moreover, this summary is not intended to identify critical elements of the invention nor delineate the scope of the invention. The sole purpose of the summary is to present some concepts of the invention in simplified form as a prelude to the more detailed description that is presented later.

In accordance with one aspect, an electrical connector assembly for providing an environmental shield comprises a bushing adapter configured to sealingly engage a bushing assembly accommodating a first electrical conductor. The bushing adapter further comprises a first bore extending longitudinally therethrough to receive the first electrical conductor. An end fitting comprises a second bore extending longitudinally therethrough to receive a second electrical conductor, and the end fitting is configured to sealingly engage the bushing adapter such that the first and second bores cooperate to define a main bore. A flowable dielectric material occupies substantially all empty space within the main bore, and at least one fill hole is in fluid communication with the main bore and configured to receive the flowable dielectric material.

In accordance with another aspect, an electrical connector assembly for providing an environmental shield comprises a bushing adapter configured to sealingly engage a bushing assembly accommodating a first electrical conductor. The bushing adapter comprises a first bore extending longitudinally therethrough to receive the first electrical conductor. An end fitting comprises a second bore extending longitudinally therethrough to receive a second electrical conductor. A spacer is disposed between the bushing adapter and the end fitting, and comprises a third bore such that the first, second, and third bores cooperate to define the main bore. A flowable dielectric material occupies substantially all empty space within the main bore. At least one fill hole extends through a sidewall of at least one of the bushing adapter, the end fitting, and the spacer. The fill hole is in fluid communication with the main bore and configured to receive the flowable dielectric material.

In accordance with yet another aspect, a method of assembling an electrical connector assembly for providing an environmental shield, comprises the steps of sealingly engaging a bushing adapter to a bushing assembly accommodating a first electrical conductor, and mechanically and electrically coupling the first electrical conductor to a second electrical conductor. The method further includes the steps of sealingly engaging the bushing adapter to an end fitting to define a main bore including the first and second electrical conductors, and introducing a flowable dielectric material into the main bore via at least one fill hole until the dielectric material occupies substantially all empty space within the main bore.

It is to be understood that both the foregoing general description and the following detailed description present example and explanatory embodiments of the invention, and are intended to provide an overview or framework for understanding the nature and character of the invention as it is claimed. The accompanying drawings are included to provide a further understanding of the invention and are incorporated into and constitute a part of this specification. The drawings illustrate various example embodiments of the invention, and together with the description, serve to explain the principles and operations of the invention.

BRIEF DESCRIPTION OF THE DRAWINGS

The foregoing and other aspects of the present invention will become apparent to those skilled in the art to which the present invention relates upon reading the following description with reference to the accompanying drawings, in which.

DESCRIPTION OF EXAMPLE EMBODIMENTS

Figure 1:
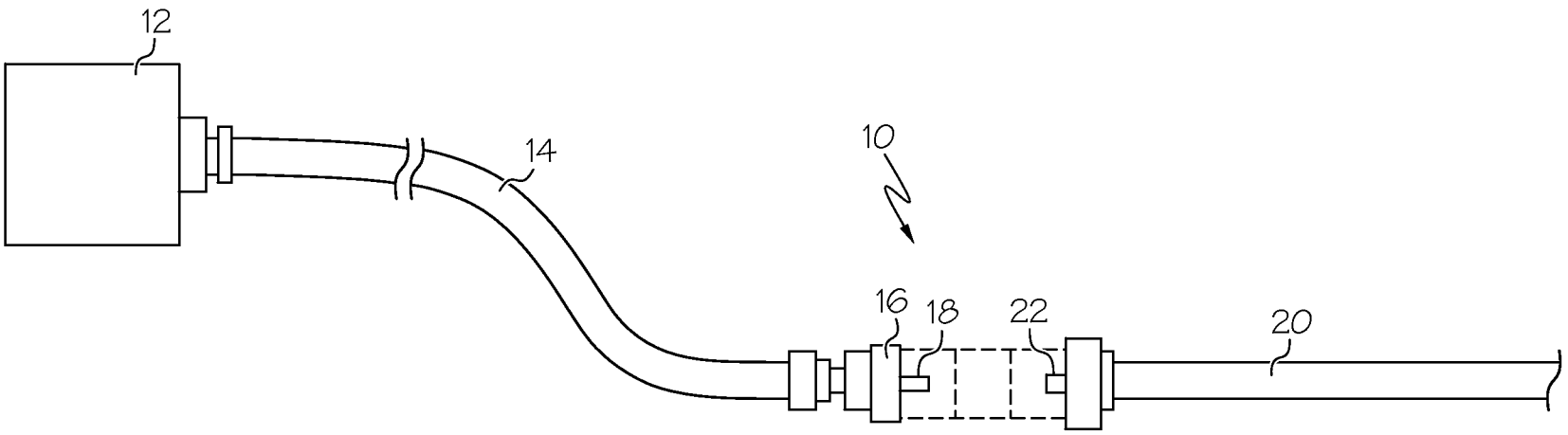
FIG. 1 is a schematic view of an example electrical connector assembly.
Figure 2:
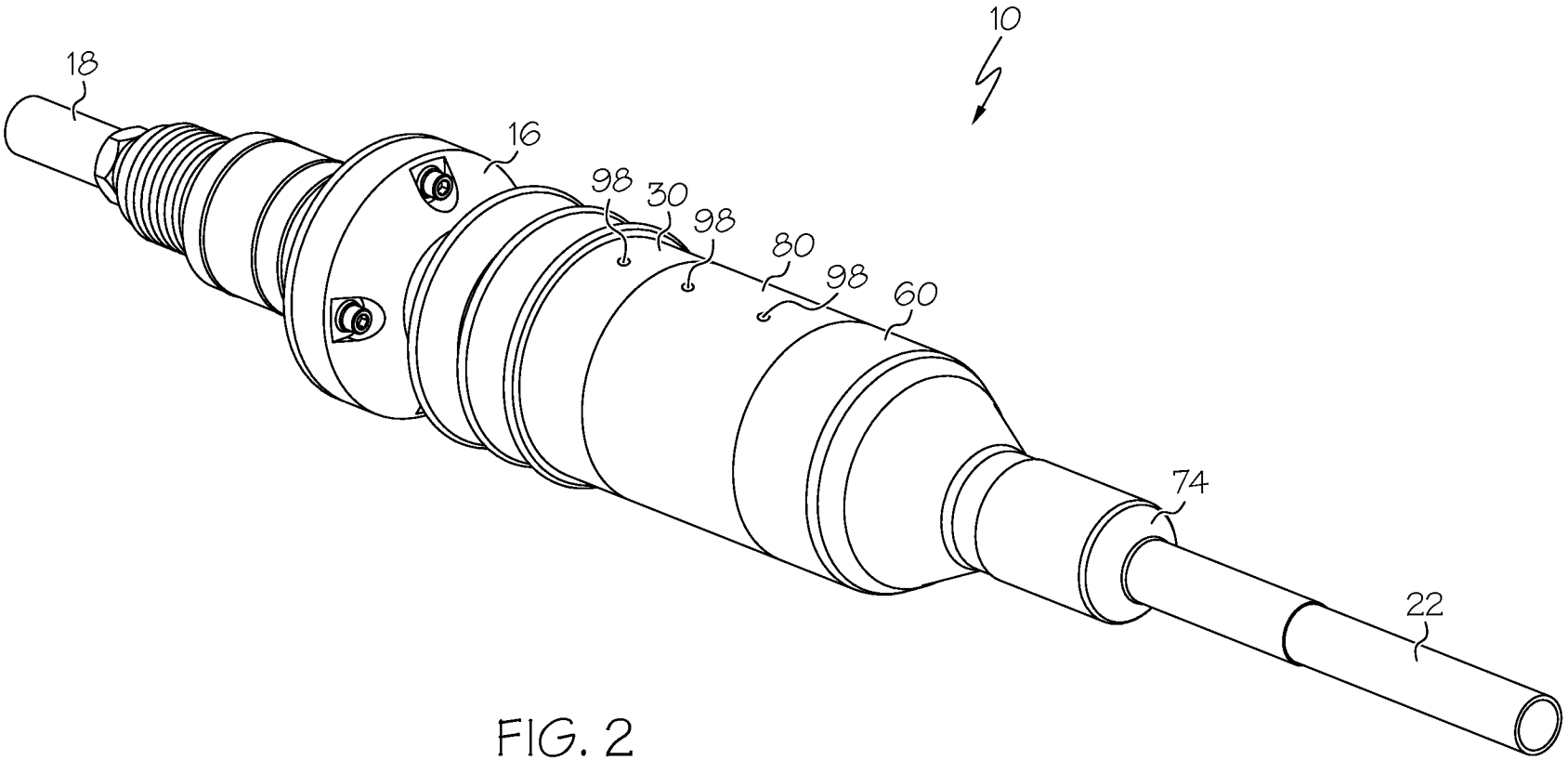
FIG. 2 is a perspective view of the example electrical connector assembly.

Example embodiments that incorporate one or more aspects of the present invention are described and illustrated in the drawings. These illustrated examples are not intended to be a limitation on the present invention. For example, one or more aspects of the present invention can be utilized in other embodiments and even other types of devices. Moreover, certain terminology is used herein for convenience only and is not to be taken as a limitation on the present invention. Still further, in the drawings, the same reference numerals are employed for designating the same elements.

Turning to the shown example of FIG. 1, an example electrical connector assembly 10 is illustrated in an environment that includes harsh environmental conditions. The electrical connector assembly 10 can be used in a number of environments, and it is to be appreciated that FIG. 1 is only a generic/schematic depiction of the electrical connector assembly 10. For instance, in one example, the electrical connector assembly 10 can be used in a variety of nuclear environments, such as nuclear power plants, nuclear powered ships, or the like. Other example environments can include, but are not limited to, steel mills, factories, hydro plants, etc. Some or all of these environments may contain electromagnetic interference. It is to be understood, however, that the electrical connector assembly 10 could be used in nearly any environment, including environments having electromagnetic interference (e.g., radio frequency interference), and is not limited to the environments set forth herein.

The electrical connector assembly 10 can be used to couple a source of power to an electrical device 12, which is only generically/schematically depicted as it is understood that the electrical device 12 can include nearly any type of electrical device. For instance, in one example, the electrical device 12 can include a number of different transmitters, sensors, fans, pumps, etc. However, nearly any type of electrical device is contemplated, including nuclear devices, or the like. Moreover, it is contemplated that the electrical connector assembly 10 can be scaled to suit various electrical load capacities. For example, the electrical connector assembly 10 can be scaled to accommodate relatively low electrical loads, such as those carried by 0 or 2 AWG conductors. In another example, as generally shown in the drawings, the electrical connector assembly 10 can be scaled to accommodate relatively high electrical loads. As shown, the electrical conductors are sized at 1500 MCM (e.g., about 1.2-1.5 inches in diameter) capable of supplying at least approximately 15,000 volts at about 880 amps. It is further understood that the electrical conductors can be provided as stranded or solid core conductors. Additionally, as is generally known, the wires, cables, or conductors can be surrounded by a cable jacket, heat shrink tubing, braid shield, or similar outer protective layers that can cover the one or more conductors.

A conduit 14 can be attached to the electrical device 12 at one end and to a bushing assembly 16 at an opposing end. The bushing assembly 16 can accommodate a first electrical conductor 18. Another conduit 20 can include a second electrical conductor 22 extending to an electrical device (not shown), such as a power source or the like. As will be described in detail below, the electrical connector assembly 10 is provided to as a fast and effective way to make an electrical connection between the first and second electrical conductors 18, 22 while also reducing the effects of the harsh and/or corrosive environmental conditions.

Turning now to FIGS. 2-4B, the electrical connector assembly 10 includes a bushing adapter 30 configured to sealingly engage the bushing assembly 16. Although illustrated as having a curved, generally circular geometry, it is contemplated that the bushing adapter 30 can have various geometries that correspond with the geometry of the bushing assembly 16. Additionally, the bushing adapter 30 can include a first bore 32 extending longitudinally therethrough to receive the first electrical conductor 18. The first bore 32 can be defined within an interior area of the bushing adapter 30 bounded by an outer sidewall 34. For example, as shown, the bushing adapter 30 can be formed with a generally cylindrical geometry with the first bore 32 extending therethrough. It can be generally beneficial to have the first bore 32 sized to occupy a substantial portion of the inner volume of the bushing adapter 30 so as to accommodate electrical conductors of various sizes.

The bushing adapter 30 can further include a wall 36 extending at least partially across the first bore 32 to define an outboard side 38 of the bushing adapter 30 and an inboard side 40 of the bushing adapter 30. The outboard side 38 corresponds to the side facing the bushing assembly 16, while the inboard side 40 corresponds to the opposite side. The wall 36 can have various geometries, and may extend partially or completely across the first bore 32. In the shown example, the wall 36 extends completely across the first bore 32 from sidewall to sidewall, and is located generally centrally although the location can be adjusted to accommodate different bushing assemblies 16. Further, the wall 36 can be oriented at various angles through the first bore 32, such as generally perpendicular to a longitudinal axis or even at various other angles relative to the longitudinal axis.

Additionally, the wall 36 can include a first hole 42 extending through the wall 36 that is configured to receive the first electrical conductor 18. The first hole 42 can have a size slightly larger than that of the first electrical conductor 18, which can be used to generally align, such as center, the bushing assembly 16 with the bushing adapter 30. The first hole 42 can also be used to facilitate securing the bushing adapter 30 to the bushing assembly 16. In one example, the first electrical connector 18 can be configured to engage a mechanical fastener against the wall 36, such as having a threaded end that receives a threaded nut 44 or the like. A lock washer 46 may also be used between the nut 44 and wall 36 to further strengthen the connection. The end of the first electrical connector 18 can further include a first terminal lug 48 thereon, such as a threaded, welded, or crimped terminal lug, and the first hole 42 may or may not be large enough to receive the first terminal lug 48. If not, the first terminal lug 48 can be coupled to the end of the first electrical conductor 18 after it is received through the first hole 42.

The bushing adapter 30 can be configured to sealingly engage the bushing assembly 16 in various manners. In one example, a sealing member, such an "O"-ring 50 or other the like, can be provided between the bushing adapter 30 and the bushing assembly 16. For example, the "O"-ring can be provided in a groove on the outboard side 38 of the bushing adapter 30, and can be adapted to be compressed upon engagement with the bushing assembly 16. The groove and/or outboard side 38 of the bushing adapter 30 may be angled or otherwise have a geometry that corresponds to that of the bushing assembly 16 to facilitate a good seal. During the assembly process, the first electrical conductor 18 can be received by the first hole 42, and the tightening of the threaded nut 44 (or other mechanical fastener) against the wall 36 can draw the bushing assembly 16 towards the bushing adapter 30 to apply a compressive force on the "O"-ring 50 to thereby seal the outboard side 38 of the first bore 32 from the external environment. In addition or alternatively, a heat-shrink material (e.g., a heat shrink tubing or the like) can be used to encapsulate the interface of the bushing assembly 16 to the bushing adapter 30 about the outboard side 38.

The bushing adapter 30 can further include other features. In one example, the wall 36 can further include one or more second hole(s) 52 extending therethrough to provide fluid communication between the outboard and inboard sides of the first bore 32 on either side of the wall 36, as will be described further herein. For example, as shown, six second holes 52 (or other number) can be provided through the wall 36, together with various support ribs or the like to provide structural support for the bushing adapter 30.

Figure 3:
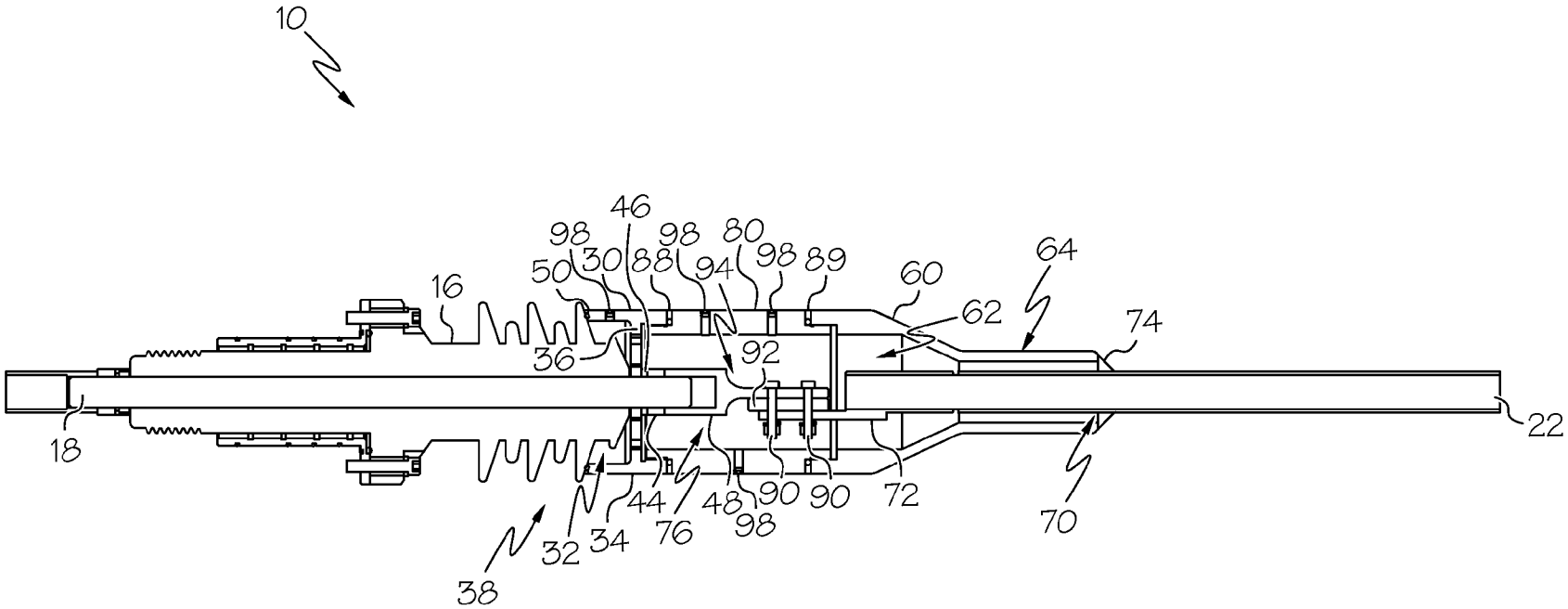
FIG. 3 is a sectional view of the example electrical connector assembly.
Figure 4B:
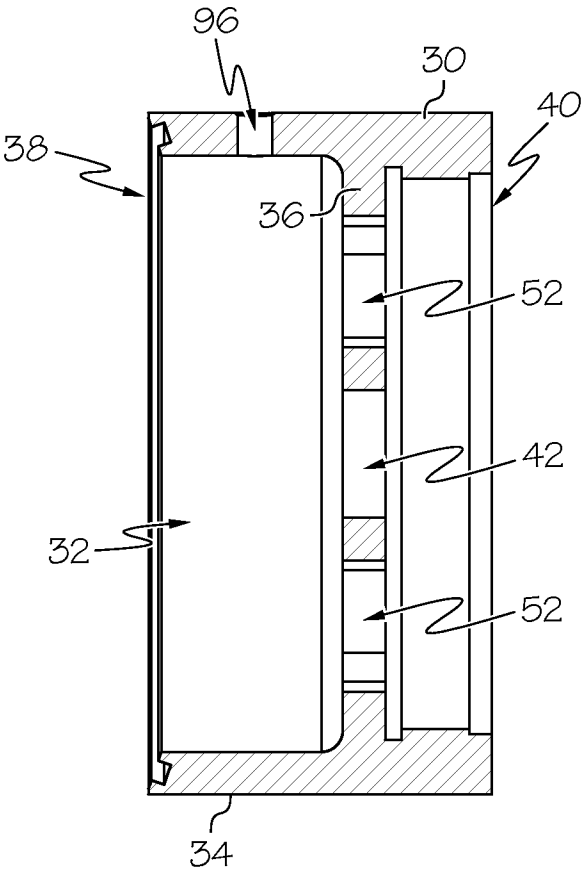
FIG. 4B is a sectional view of the bushing adapter of FIG. 4A.
Figure 4A:
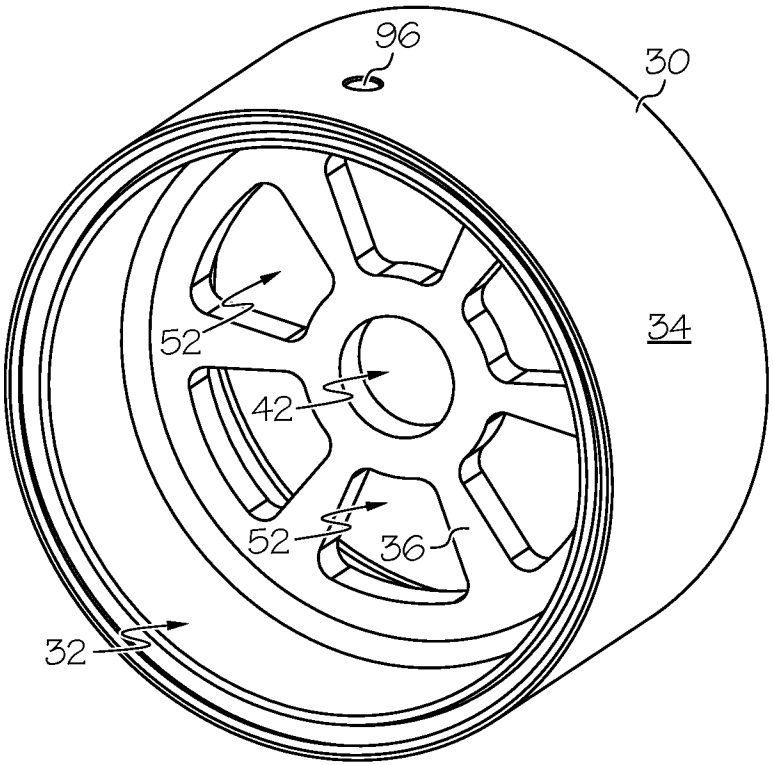
FIG. 4A is a perspective view of an example bushing adapter of the electrical connector assembly.
Figure 5B:
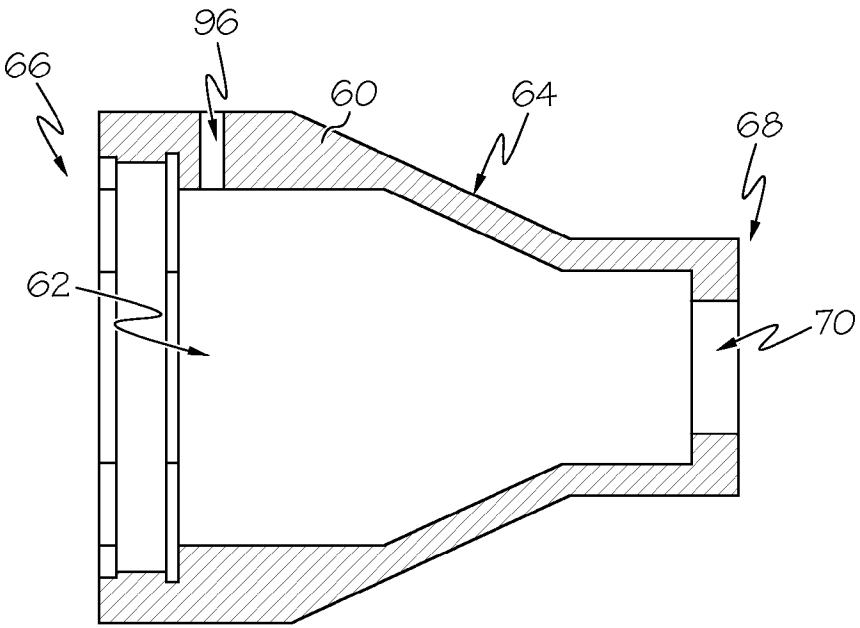
FIG. 5B is a sectional view of the end fitting of FIG. 5A.
Figure 5A:
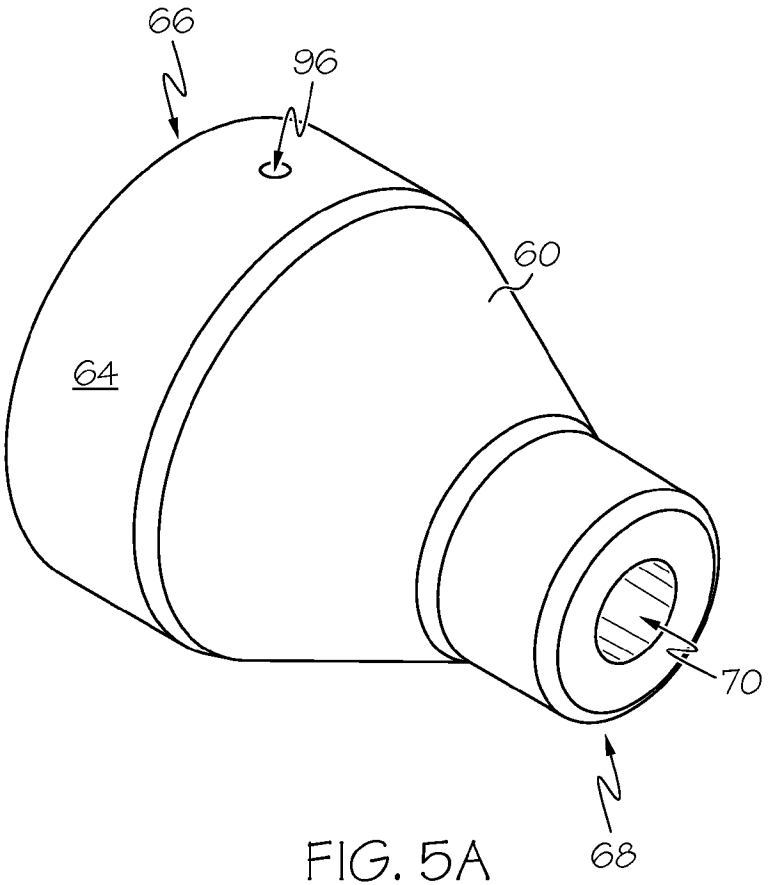
FIG. 5A is a perspective view of an example end fitting of the electrical connector assembly.

Turning now to FIGS. 3 and 5A-5B, the electrical connector assembly 10 can further include an end fitting 60 comprising a second bore 62 extending longitudinally therethrough to receive the second electrical conductor 22. Although illustrated as having a curved, generally circular geometry, it is contemplated that the end fitting 60 can have various geometries, such as a geometry that corresponds with that of the bushing adapter 30. The second bore 62 can be defined within an interior area of the end fitting 60 bounded by an outer sidewall 64. For example, as shown, the end fitting 60 can be formed with a generally cylindrical geometry with the second bore 62 extending therethrough. It can be generally beneficial to have the second bore 62 sized to occupy a substantial portion of the inner volume of the end fitting 60 so as to accommodate electrical conductors of various sizes.

Moreover, the end fitting 60 can have a relatively larger size (e.g., diameter) about an inboard side 66 that faces the bushing adapter 30, and a relatively smaller size about an outboard side 68. The relatively larger size of the inboard side 66 can provide a relatively larger interior volume for the second bore 62 to accommodate an interface between the first and second electrical conductors 18, 22, while the outboard side 68 can taper towards a smaller size generally related to the diameter of the second electrical conductor 22. Additionally, the outboard side 68 can include a hole 70 configured to receive the second electrical conductor 22 therethrough. The second electrical conductor 22 can include a second terminal lug 72 thereon, such as a threaded, welded, or crimped terminal lug, and the hole 70 may or may not be large enough to receive the second terminal lug 72. If not, the second terminal lug 72 can be coupled to the end of the second electrical conductor 22 after it is received through the hole 70. In addition or alternatively, a heat-shrink material (e.g., a heat shrink tubing 74 or the like) can be used to encapsulate the interface of the end fitting 60 to the second electrical conductor 22 generally about the outboard side 68 and hole 70 to thereby seal the second bore 62 from the outside environment.

The end fitting 60 is further configured to sealingly engage the bushing adapter 30 such that the first and second bores 32, 62 cooperate to define a main bore 76 in which the first and second electrical conductors 18, 22 are coupled together. It is contemplated that the end fitting 60 can sealingly engage the bushing adapter 30 directly or indirectly. In one example, the end fitting 60 can directly contact and sealingly engage the bushing adapter 30 using various permanent or non-permanent manners. Such a construction can be used when the first and second electrical conductors 18, 22 have a relatively smaller size. For example, the end fitting 60 can threadingly engage corresponding threaded structure of the bushing adapter 30, and a sealing member, such an "O"-ring or other the like, can be provided therebetween.

Figure 6B:
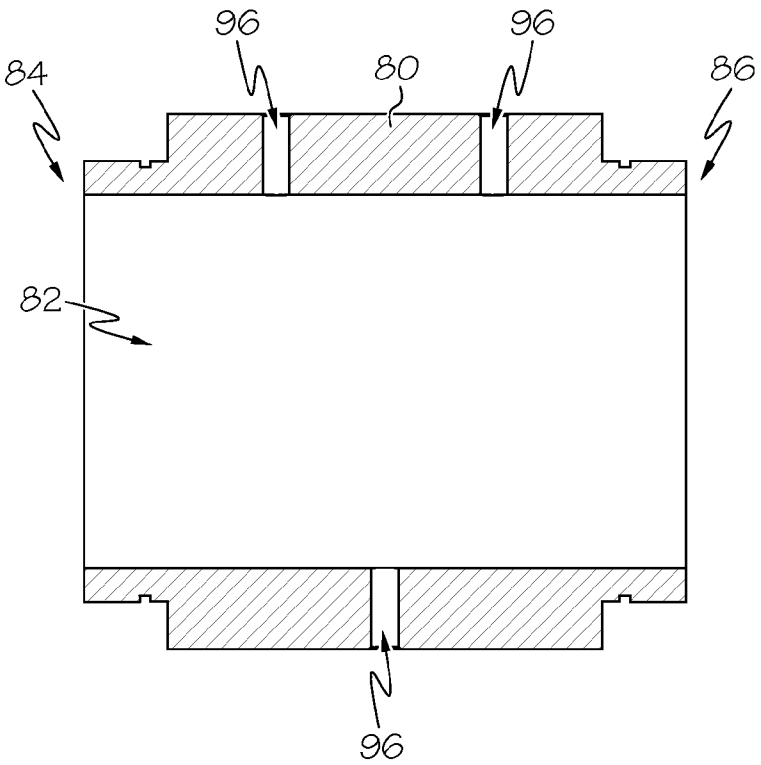
FIG. 6B is a sectional view of the spacer of FIG. 6A.
Figure 6A:
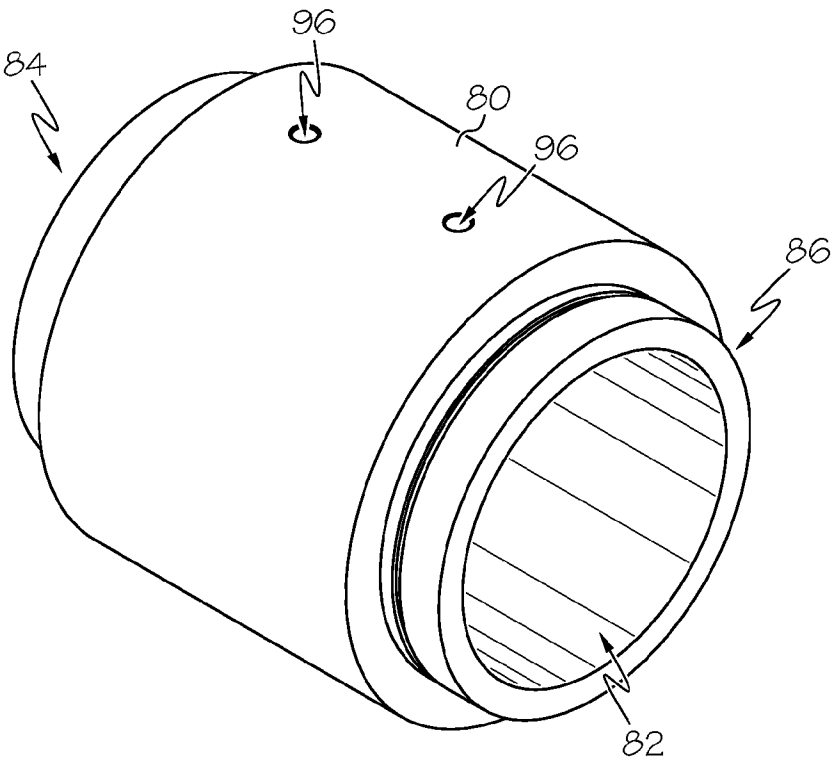
FIG. 6A is a perspective view of an example spacer of the electrical connector assembly.

Alternatively, as shown in FIGS. 3 and 6A-6B, the electrical connector assembly 10 can further include an intermediate spacer 80 disposed between the bushing adapter 30 and the end fitting 60 such that the bushing adapter 30 and the end fitting 60 are sealingly engaged indirectly. The spacer 80 can include a third bore 82 such that the first, second, and third bores 32, 62, and 82 cooperate to define the main bore 76. The optional spacer 80 can be used to expand the size of the main bore 76 to accommodate the mechanical and electrical coupling of the first and second electrical conductors 18, 22, especially when using relatively large conductors, such as 1500 MCM or other sizes. While only one spacer 80 is shown, it is understood that two or more spacers could also be used.

The spacer 80 can sealingly engage both of the bushing adapter 30 and the end fitting 60 using various permanent or non-permanent manners. For example, one end 84 of the spacer 80 can threadingly engage the inboard side 40 of the bushing adapter, and the other end 86 of the spacer can threadingly engage the inboard side 66 of the end fitting 60. While it is shown that the inboard sides 40, 66 of the bushing adapter 30 and end fitting 60 can have female threaded structure while the ends 84, 86 of the spacer 80 can have male threaded structure, it is understood that any or all of these can be interchanged. In addition or alternatively, various other removable or non-removable coupling methods can be used, such as other mechanical fasteners, press fit or snap fit, adhesives, welding, etc.

The optional spacer 80 is provided to accommodate the mechanical and electrical coupling of the first and second electrical conductors 18, 22. In one example, as shown in FIG. 3, a coupler 90 is used to mechanically and electrically couple the first and second terminal lugs 48, 72 within the main bore 76. Various removable or non-removable couplers can be used. For example, the coupler 90 can be an assembly of one or more mechanical bolt(s) and nut(s) that extends through and fastens the first and second terminal lugs 48, 72 together. As shown, a pair of 7/16" bolts and nuts can be used, together with optional washers and/or lock washers. Still various other removable or non-removable coupling methods can be used, such as other mechanical fasteners, adhesives, welding, etc. Additionally, one or more optional shim(s) 92 or the like can be used to facilitate coupling the first and second terminal lugs 48, 72 together. For example, the shim(s) 92 can include a conductive material, such as copper, that can act as a conductive spacer to bridge an offset gap between the first and second terminal lugs 48, 72. The shim(s) 92 can also receive the coupler(s) 90.

Further, the bushing adapter 30 can be sealingly engaged to the spacer 80 by an "O"-ring 88 or other sealing structure, and similarly the end fitting 60 can be sealingly engaged to the spacer 80 by an "O"-ring 89 or other sealing structure. Thus, once assembled, the entire electrical connector assembly 10 can be sealed from the outboard side 38 of the bushing adapter 30 to the outboard side 68 of the end fitting 60 such that the main bore 76 is sealed from the external environment. However, it can be desirable to provide additional protection against the harsh external environment.

Keeping with FIG. 3, the electrical connector assembly 10 can further include a dielectric material 94 occupying substantially all empty space within the main bore 76. By empty space, it is meant the internal void space within the main bore 76 not otherwise occupied by other structure received therein, including but not limited to the bushing assembly 16, wall 36, first and second conductors 18, 22 and terminal lugs 48, 72, coupler(s) 90, etc. Various types of dielectric material 94 can be used. Preferably, the dielectric material 94 is capable of withstanding high doses of radiation and vibration, as well as considerable heat and moisture often in the form of superheated steam, and numerous other corrosive chemicals.

In one example, the dielectric material 94 can be a flowable dielectric material 94 that, by the nature of flowable fluids, will tend to fill up substantially all empty space within the main bore 76 so as to eliminate air pockets that can produce ozone or permit infiltration of the external environment. Thus, the dielectric material 94 can substantially encapsulate the elements received within the main bore 76 and thereby protect against infiltration of the harsh external environment. In addition or alternatively, the flowable dielectric material 94 can be a curable material, and/or a translucent or transparent material. For example, a cured and translucent or transparent dielectric material 94 can permit the user to easily inspect the electrical terminations by separating some or all of the bushing adapter 30, end fitting 60, and/or spacer 80. Further, a cured and translucent or transparent dielectric material 94 can provide easy clean-up of the splice if it needs to be later disconnected. In one example, the dielectric material 94 can include silicone, such as RTV-2 silicone. RTV-2 silicone is generally transparent, flexible, removable, exhibits relatively low thermal expansion, and is flowable with a low viscosity to substantially encapsulate the electrical terminations within the main bore 76 in a generally air-tight manner. Still, various other types/grades of silicone or even other dielectric materials can be used.

The dielectric material 94 can be introduced into the main bore 76 in various manners. In one example, the dielectric material 94 can be introduced progressively as the bushing adapter 30, spacer 80, and end fitting 60 are assembled together. In another example, where a flowable dielectric material 94 is used, it can be introduced into the main bore 76 after the bushing adapter 30, spacer 80, and end fitting 60 are assembled and sealed together. Additionally, it can be preferable to introduce the dielectric material 94 after the heat shrink tubing 74 is applied to the end fitting 60. For example, the flowable dielectric material 94 can be introduced into the main bore 76 via at least one fill hole 96 that is in fluid communication with the main bore 76. In one example, the at least one fill hole 96 can be located about the outboard sides 38, 68 of the bushing adapter 30 and/or end fitting 60. In another example, the at least one fill hole 96 can extend through the sidewall 34, 64 of at least one of the bushing adapter 30 and the end fitting 60, respectively. In addition or alternatively, at least one fill hole 96 can be provided in the spacer 80. The at least one fill hole 96 is arranged to be in fluid communication with the main bore 76 and is configured to receive the flowable dielectric material 94. In one example, a plurality of fill holes 96 can be provided in any or all of the bushing adapter 30, end fitting 60, and/or spacer 80 so that the dielectric material 94 can be introduced at different locations and/or while also providing a vent to release the displaced air from the main bore 76.

Due to the nature of flowable fluids, the dielectric material 94 introduced into at least one fill hole 96 associated with one of the first, second, and third bores 32, 62, 82 will tend to flow into the other bores. For example, as noted above, the wall 36 of the bushing adapter 30 can include one or more second hole(s) 52 extending therethrough to provide fluid communication between the outboard and inboard sides of the first bore 32 on either side of the wall 36. Thus, dielectric material 94 introduced into the main bore 76 at various locations can flow through the second hole(s) 52 and provide a generally continuous seal around the portion of the bushing assembly 16 received in the outboard side 38 of the first bore 32. Conversely, where at least one fill hole 96 extends through the sidewall of the bushing adapter 30 and is located on the outboard side 38, the dielectric material 94 introduced therein will pass through the second hole(s) 52 and into the remainder of the main bore 76. The dielectric material 94 can also be introduced into multiple fill holes 96 simultaneously or sequentially to fill up substantially all empty space within the main bore 76. Filling may be done in stages or include pauses for settling time and/or movement, shaking, and/or vibration to reduce, such as eliminate, trapped air pockets in the main bore 76 and/or dielectric material 94.

The dielectric material 94 can be introduced into the main bore 76 to a preset volume and/or until it overflows. Where the dielectric material 94 is curable, it can self-seal the one or more fill holes 96 against the external environment. In addition or alternatively, a plug 98 can be provided to sealingly engage the at least one fill hole 96 and thereby seal in the dielectric material 94. For example, a separate plug 98 can be provided for each fill hole 96. The plug(s) 98 can be removably or non-removably coupled into each hole 96. In one example, the plug(s) 98 can be ⅛" hex socket plugs that are threadingly engaged into each hole 96. In other examples, the plug(s) 98 can be press fit, snap fit, held in by other mechanical fasteners, adhesives or even the cured dielectric material 94. Alternatively, the plug 98 could be formed of an adhesive or the like.

A method of assembling the electrical connector assembly 10 is also provided. It is understood that the following steps may be performed in various orders, and that some of the steps may be omitted or other steps added. Initially, a bushing assembly 16 can be sealingly engaged to the bushing adapter 30 by inserting the end of the first electrical conductor 18 into the first hole 42 of the wall 36. Next, the first electrical conductor 18 can be coupled to the bushing adapter 30, such as by a nut 44 threaded onto the end of the first electrical conductor 18 and tightened against the wall 36. Next, the first terminal lug 48 can be coupled to the first electrical conductor 18, such as by a threaded connection.

The end fitting 60, and optional spacer 80 (if used), can receive the second electrical conductor 22, and the second terminal lug 72 can be coupled to (or already be a part of) the second electrical conductor 22. Next, the first electrical conductor 18 can be mechanically and electrically coupled to the second electrical conductor 22 by the coupler 90. At this time, the end fitting 60 and spacer 80 may be moved away from the bushing adapter 30 to provide the user adequate room to work on the first and second electrical conductors 18, 22. Next, the end fitting 60 and optional spacer 80 are moved towards the bushing adapter 30. The end fitting 60 is sealingly engaged to the bushing adapter 30, either directly or indirectly via the optional spacer 80. Next, a heat-shrink material (e.g., a heat shrink tubing 74 or the like) can be used to encapsulate the interface of the end fitting 60 to the second electrical conductor 22 generally about the outboard side 68 and hole 70 to thereby seal the main bore 76 from the outside environment. A similar heat-shrink material may also be used about the interface of the bushing assembly 16 and bushing adapter 30. Next, a flowable dielectric material is introduced into the main bore 76 via one or more fill holes 96 until the dielectric material 94 occupies substantially all empty space within the main bore 76. Next, plugs 98 can sealingly engage each fill hole 96. Alternatively, the dielectric material 94 can be provided to the main bore 76 before the bushing adapter 30, end fitting 60, and spacer 80 are sealingly engaged together. Finally, where a curable dielectric material 94 is used, the user may disassemble the bushing adapter 30, end fitting 60, and/or spacer 80 to visually inspect the electrical termination of the first and second electrical conductors 18, 22. Where maintenance is to be performed, the cured dielectric material 94 can be removed, the maintenance performed, and then the main bore 76 re-filled with additional dielectric material 94 as described herein.

The invention has been described with reference to the example embodiments described above. Modifications and alterations will occur to others upon a reading and understanding of this specification. Examples embodiments incorporating one or more aspects of the invention are intended to include all such modifications and alterations insofar as they come within the scope of the appended claims.

What is claimed is:

1. An electrical connector assembly for providing an environmental shield, comprising:

a bushing adapter configured to sealingly engage a bushing assembly accommodating a first electrical conductor, and comprising a first bore extending longitudinally therethrough to receive the first electrical conductor;

an end fitting comprising a second bore extending longitudinally therethrough to receive a second electrical conductor, the end fitting being configured to sealingly engage the bushing adapter such that the first and second bores cooperate to define a main bore;

a flowable dielectric material occupying substantially all empty space within the main bore; and at least one fill hole being in fluid communication with the main bore and configured to receive the flowable dielectric material.

2. The electrical connector assembly of claim 1, wherein the at least one fill hole extends through a sidewall of at least one of the bushing adapter and the end fitting, and further comprising a plug sealingly engaging the at least one fill hole.

3. The electrical connector assembly of claim 1, wherein the flowable dielectric material comprises a curable material.

4. The electrical connector assembly of claim 1, wherein the flowable dielectric material comprises silicone.

5. The electrical connector assembly of claim 1, further comprising a first terminal lug on the first electrical conductor, a second terminal lug on the second electrical conductor, and a coupler to mechanically and electrically couple the first and second terminal lugs within the main bore.

6. The electrical connector assembly of claim 1, wherein the bushing adapter comprises a wall extending at least partially across the first bore to define an outboard side of the bushing adapter and an inboard side of the bushing adapter.

7. The electrical connector assembly of claim 6, the bushing adapter further comprising a first hole extending through the wall that is configured to receive the first electrical conductor, and a second hole extending through the wall that is in fluid communication with the second bore of the end fitting.

8. The electrical connector assembly of claim 7, wherein the second hole provides fluid communication between the outboard and inboard sides of the bushing adapter, and wherein the at least one fill hole extends through the sidewall of the bushing adapter and is located on the outboard side of the bushing adapter.

9. The electrical connector assembly of claim 1, wherein the end fitting further comprises an inboard side facing the bushing adapter and an outboard side with a hole configured to receive the second electrical conductor, and further comprising a seal encapsulating the outboard side to seal the main bore from an outside environment.

10. The electrical connector assembly of claim 1, further comprising a spacer disposed between the bushing adapter and the end fitting, and comprising a third bore such that the first, second, and third bores cooperate to define the main bore.

11. The electrical connector assembly of claim 10, wherein the bushing adapter is coupled to the spacer by a threaded connection, and wherein the end fitting is coupled to the spacer by a threaded connection.

12. The electrical connector assembly of claim 11, wherein the bushing adapter is sealingly engaged to the spacer by an "O"-ring, and wherein the end fitting is sealingly engaged to the spacer by an "O"-ring.

13. An electrical connector assembly for providing an environmental shield, comprising:

a bushing adapter configured to sealingly engage a bushing assembly accommodating a first electrical conductor, and comprising a first bore extending longitudinally therethrough to receive the first electrical conductor;

an end fitting comprising a second bore extending longitudinally therethrough to receive a second electrical conductor;

a spacer disposed between the bushing adapter and the end fitting, and comprising a third bore such that the first, second, and third bores cooperate to define the main bore;

a flowable dielectric material occupying substantially all empty space within the main bore; and at least one fill hole extending through a sidewall of at least one of the bushing adapter, the end fitting, and the spacer, wherein the fill hole is in fluid communication with the main bore and configured to receive the flowable dielectric material.

14. The electrical connector assembly of claim 13, wherein the bushing adapter is sealingly engaged to the spacer by an "O"-ring, and wherein the spacer is sealingly engaged to the end fitting by an "O"-ring.

15. The electrical connector assembly of claim 13, wherein the bushing adapter comprises a wall extending at least partially across the first bore, the wall comprising a first hole configured to receive the first electrical conductor and a second hole that is in fluid communication with the main bore.

16. The electrical connector assembly of claim 13, wherein the bushing adapter is coupled to the spacer by a threaded connection, and wherein the end fitting is coupled to the spacer by a threaded connection.

17. A method of assembling an electrical connector assembly for providing an environmental shield, comprising the steps of:

sealingly engaging a bushing adapter to a bushing assembly accommodating a first electrical conductor;

mechanically and electrically coupling the first electrical conductor to a second electrical conductor;

sealingly engaging the bushing adapter to an end fitting to define a main bore including the first and second electrical conductors; and introducing a flowable dielectric material into the main bore via at least one fill hole until the dielectric material occupies substantially all empty space within the main bore.

18. The method of claim 17, wherein the at least one fill hole extends through a sidewall of at least one of the bushing adapter and the end fitting, and further comprising the step of sealing the at least one fill hole with a plug.

19. The method of claim 17, further comprising the step of sealingly engaging the bushing adapter to the end fitting indirectly via an intermediate spacer.

20. The method of claim 17, further comprising the step of sealing an interface between the end fitting and the second electrical conductor prior to the step of introducing the flowable dielectric material into the main bore.

* * * * *